US005415402A

United States Patent [19]

Morrison et al.

[11] Patent Number: 5,415,402

[45] Date of Patent: May 16, 1995

[54] MAGNETIC BALL-WALKER FOR A PINBALL GAME

[75] Inventors: Robert S. Morrison, Elgin; Edward F. Hicks, Palatine, both of Ill.

[73] Assignee: Williams Electronics Games, Inc., Chicago, Ill.

[21] Appl. No.: 236,966

[22] Filed: May 2, 1994

[51] Int. Cl.[6] ..... A63F 7/30

[52] U.S. Cl. ..... 273/121 A; 273/119 A

[58] Field of Search ..... 273/118, 119, 121, 127 R, 273/127 V, 127 W

[56] References Cited

U.S. PATENT DOCUMENTS 5,356,142 10/1994 Borg et al. ..... 273/121 A

*Primary Examiner*—Raleigh W. Chiu

*Attorney, Agent, or Firm*—Rockey, Rifkin and Ryther

[57] ABSTRACT

The magnetic ball-walker of the invention comprises an L-shaped arm which rotates in a plane perpendicular to the playfield for transporting a pinball between first and second playfield surfaces. The arm carries an electromagnet on one end and a counterweight on the other, the counterweight maintaining the arm in a ball receiving position. In this position, a ferromagnetic ball received from the first surface can be captured by the electromagnet if energized. The momentum of the rolling ball causes the arm to rotate to a ball discharge position so that the ball can be discharged onto the second surface by deenergizing the electromagnet.

16 Claims, 1 Drawing Sheet

MAGNETIC BALL-WALKER FOR A PINBALL GAME

BACKGROUND OF THE INVENTION

The present invention relates generally to pinball games and, more particularly, to an improved play feature for such games which is designed to foster and to maintain player interest therein.

A typical pinball game includes an inclined playfield which supports a rolling ball, a pair of flippers, a vertical backbox and a variety of play features. The person who plays the game controls flippers mounted on the playfield which, when activated by the player at the appropriate time, propel the pinball across playfield. A typical object of pinball games is for the player to direct pinballs at selected play features or targets to score points.

As will be appreciated, the success of a manufacturer's line of pinball games depends on its ability to attract players to its games. To attract players, it is necessary to provide new, exciting and challenging play features that test the player's skill in addition to entertaining the player.

Increasingly, games are provided with play features that require player involvement beyond the use of the flippers. Play features such as these require player skill to complete. Thus, a novel play feature for a pinball game which attracts and entertains players by requiring more player involvement is desired.

SUMMARY OF THE INVENTION

The invention comprises an L-shaped arm which rotates in a plane perpendicular to the playfield for transporting a pinball between first and second surfaces preferably disposed above the playfield. The arm carries an electromagnet on one end and a counterweight on the other, the counterweight maintaining the arm in a ball receiving position. In this position, a ferromagnetic ball on a first surface can be captured by the electromagnet if energized. The ball's momentum as it reaches the arm causes the arm to rotate to a ball discharge position, whereby the ball can be discharged onto a second surface by deenergizing the electromagnet.

In one mode of operation of the invention, a player attempts to "catch" the ball with the electromagnet by activating a player operated switch, such as a flipper switch, to signal the game microprocessor to energize the electromagnet. In a second mode of operation, a playfield sensor signals the game microprocessor to energize the electromagnet to "catch" a pinball which approaches the electromagnet. If the ball is not caught, the ball merely drops back to the playfield.

DETAILED DESCRIPTION OF A PREFERRED EMBODIMENT

Figure 1:
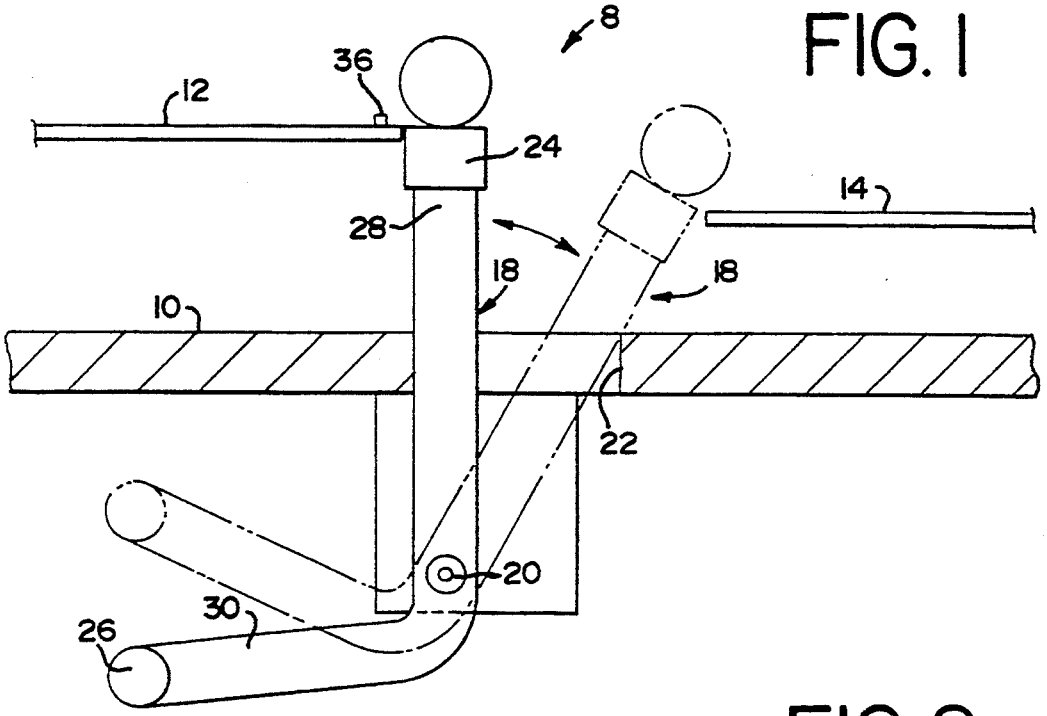
FIG. 1 is a partial-section side view of the magnetic ball-walker of the invention.
Figure 2:
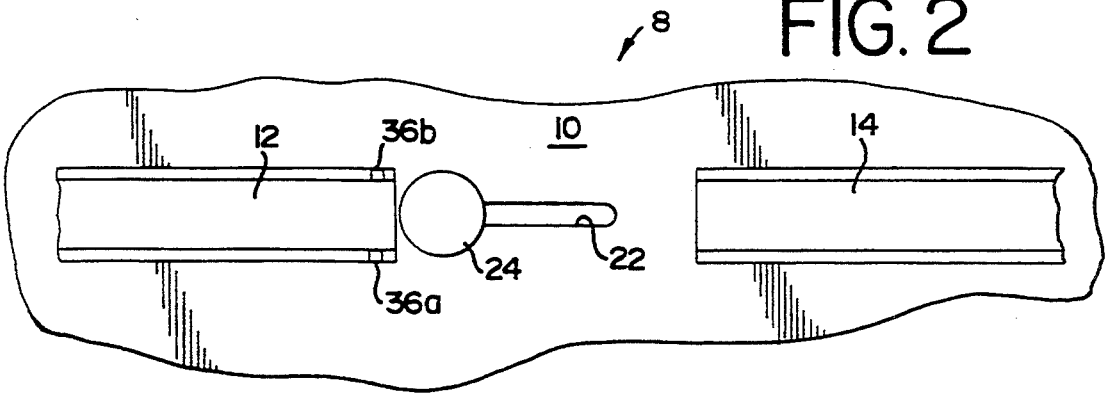
FIG. 2 is a top view of the magnetic ball-walker.
Figure 3:
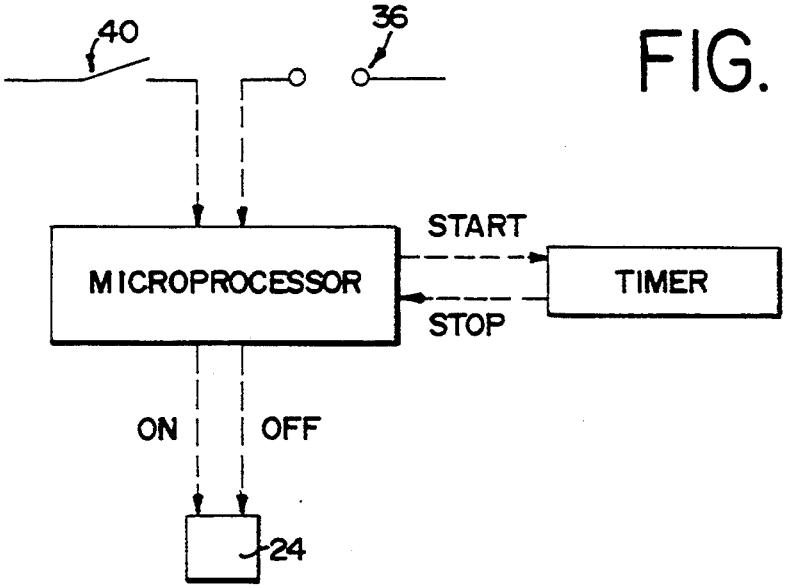
FIG. 3 illustrates a block diagram of the control system for the magnetic ball-walker.

Referring to FIGS. 1 and 2, side and top views of the magnetic ball-walker 8 are shown relative to an inclined playfield 10 of a pinball game. A first surface 12 and a second, lower surface 14 are mounted above playfield

10. Preferably, these surfaces are ramps capable of carrying the ball to and from the play feature of the invention and can be of any construction. However, the portions of surfaces 12 and 14 adjacent ball-walker 8 must be of a non-conductive material such as plastic to prevent them from becoming magnetized by ball-walker 8.

Ball walker 8 includes a rotatable arm 18 which rotates about pivot pin 20 in a plane perpendicular to playfield 10. Pivot pin 20 is mounted on support 21 that, in turn, is mounted to the underside of playfield 10. Arm 18 rotates between a ball receiving position shown in solid line and a ball discharge position shown in phantom and reciprocates in playfield aperture 22.

Preferably, arm 18 is L-shaped and comprises a substantially vertical portion 28 carrying electromagnet 24 at its end and a substantially horizontal portion 30 carrying counterweight 26 at its end. The arm 18 is maintained in the ball receiving position (shown in solid line in FIG. 1) by the weight of counterweight 26 acting to maintain arm 18 abutted against the end of aperture 22. The electromagnet 24 is provided to "catch" the ferromagnetic pinball and to transport it from first surface 12 to second surface 14 as discussed hereafter.

When a pinball 34 rolls onto the electromagnet 24 from surface 12, its momentum as it reaches arm 18 causes arm 18 to rotate about pivot pin 20 to the discharge position shown in phantom in FIG. 1, provided that the electromagnet 24 has been activated and captures the ball. When the ball has been discharged, arm 18 will return to the ball receiving position (shown in solid line) under the weight of counterweight 26.

In one mode of operation of the invention, a sensor 36, preferably an optical switch having a light emitter **36*a* and a light detector 36*b*, is provided on first surface 12 to detect the pinball. Sensor 36 signals the game microprocessor to energize electromagnet 24 to "catch" an approaching ferromagnetic pinball. The microprocessor further includes a timer circuit that deenergizes electromagnet 24 after a predetermined time thereby to discharge the suspended pinball after arm 18** rotates to the ball discharge position.

In a second mode of operation of the invention, activation of a player operated switch, such as a flipper control switch 40, signals the game microprocessor to energize electromagnet 24. Thus, the player must activate the flipper switches at the appropriate time to "catch" the pinball thereby to transport it to second surface 14. The timer circuit signals the game microprocessor to deenergize electromagnet 24 when arm 18 rotates to the ball discharge position. If the player fails to correctly operate the electromagnet, the ball simply rolls off the electromagnet and drops back to the playfield.

It should be noted that the two modes of operation of the invention can both be used such that the ball-walker can be operated either manually or automatically as determined by the game program. When operated manually, bonus points can be added to the player's score when a ball is successfully transported.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A pinball game comprising:

a) an inclined playfield for supporting a rolling ferromagnetic ball and a plurality of play features;

b) one of said plurality of play features including:

1) an arm mounted for rotation in a plane perpendicular to said playfield;

2) an electromagnet attached to one end of said arm for capturing a moving ferromagnetic pinball from a first location and for discharging said ball onto a second location, the arm being rotated by the inertia of the moving ball from the first to the second location; and 3) control means for energizing said electromagnet to capture the ball and for deenergizing said electromagnet to discharge said ball.

2. The pinball game of claim 1 wherein the control means further includes a microprocessor and a sensor, said sensor for detecting the approach of a pinball to the first location and for signalling said microprocessor to energize the electromagnet.

3. The pinball game of claim 1 wherein said control means further includes a microprocessor and a player operated switch, said switch for detecting the approach of the ball and for signalling said microprocessor to energize said electromagnet.

4. The pinball game of claim 1 wherein the control means includes a timer means for signalling said control means to deenergize the electromagnet a predetermined time after it is energized.

5. The pinball game of claim 1 further including means for returning the arm from the second location to the first location.

6. The pinball game of claim 5 wherein the returning means includes a counterweight that rotates the arm under gravity.

7. The pinball game of claim 1 wherein the arm is mounted for rotation in a pivot means located below the playfield, said arm extending through a slot in the playfield such that said electromagnet is above the playfield.

8. The pinball game of claim 1 wherein the first and second locations include elevated ramps.

9. A pinball game comprising:

a) at least one rolling ferromagnetic ball;

b) an inclined playfield for supporting said ball;

c) an arm mounted to said playfield for rotation;

d) an electromagnet attached to one end of said arm for picking up a moving pinball from a first location and for discharging said ball at a second location when said arm rotates to a ball discharge position, the arm being rotated by the momentum of the moving pinball; and e) microprocessor means for energizing said electromagnet near said first location to capture the pinball and for deenergizing the electromagnet near said second location to discharge the ball.

10. The pinball game of claim 9 wherein the microprocessor means includes a sensor and a microprocessor, said sensor for detecting the approach of a pinball to the first location and for signalling said microprocessor energize the electromagnet.

11. The pinball game of claim 9 wherein said microprocessor means includes a player operated switch and a microprocessor, said switch for detecting the approach of the ball and for signalling said microprocessor to energize said electromagnet.

12. The pinball game of claim 9 wherein the microprocessor means includes a timer means for signalling said microprocessor means to deenergize the electromagnet a predetermined time after it is energized.

13. The pinball game of claim 9 further including means for returning the arm from the second location to the first location.

14. The pinball game of claim 13 wherein the returning means includes a counterweight that rotates the arm under gravity.

15. The pinball game of claim 9 wherein the arm is mounted for rotation in a pivot means located below the playfield, said arm extending through a slot in the playfield such that said electromagnet is above the playfield.

16. The pinball game of claim 9 wherein the first and second locations include elevated ramps.

* * * * *